US008792664B2

(12) United States Patent
Bewley et al.

(10) Patent No.: US 8,792,664 B2
(45) Date of Patent: Jul. 29, 2014

(54) HEADWORN SOUND PROCESSOR CASE

(75) Inventors: Michael Stuart Bewley, Neutral Bay (AU); Hans Yoo, Ryde (AU); Christopher Jonathan Chia, North Ryde (AU); Orlando Wu, Padstow (AU); Ryan Orin Melman, Randwick (AU); Alex Ming Duk Leung, Carlingford (AU); John Joseph Chapman, Pennant Hills (AU)

(73) Assignee: Cochlear Limited, Macquarie University, NSW (AU)

( * ) Notice: Subject to any disclaimer, the term of this patent is extended or adjusted under 35 U.S.C. 154(b) by 377 days.

(21) Appl. No.: 13/010,630

(22) Filed: Jan. 20, 2011

(65) Prior Publication Data

US 2012/0189148 A1 Jul. 26, 2012

(51) Int. Cl.
*H04R 25/00* (2006.01)

(52) U.S. Cl.
CPC ..... *H04R 25/00* (2013.01); *H04R 2225/021* (2013.01)
USPC ..... 381/322; 381/330

(58) Field of Classification Search
USPC ..... 381/23.1, 312, 322, 324, 326, 330; 600/25; 607/55–57
See application file for complete search history.

(56) References Cited

U.S. PATENT DOCUMENTS

| | | | | |
|---|---|---|---|---|
| 6,920,229 | B2 * | 7/2005 | Boesen | 381/326 |
| 7,660,633 | B2 * | 2/2010 | Darley et al. | 607/57 |
| 7,729,774 | B1 * | 6/2010 | Lynch et al. | 607/57 |
| 2009/0074221 | A1 | 3/2009 | Westermann | |
| 2009/0092270 | A1 | 4/2009 | Ho et al. | |
| 2011/0002493 | A1 | 1/2011 | Campbell et al. | |

FOREIGN PATENT DOCUMENTS

WO WO-2006071210 7/2006

OTHER PUBLICATIONS

International Search Report and Written Opinion for International Application No. PCT/IB2011/056020 mailed Sep. 27, 2012 (10 pages).

* cited by examiner

*Primary Examiner* — Brian Ensey
(74) *Attorney, Agent, or Firm* — K&L Gates, LLP

(57) ABSTRACT

A case for encasing a hearing device to allow the wearer to continue wearing the device while engaging in activities such as swimming. In certain embodiments, the case comprises a protective portion for providing mechanical protection to the device and a flexible portion for housing a coil associated with the hearing device. In specific embodiments, the case also includes one or more acoustic ports.

20 Claims, 7 Drawing Sheets

HEADWORN SOUND PROCESSOR CASE

BACKGROUND

1. Field of Invention

The present disclosure relates to casings for hearing devices such as behind the ear (BTE) hearing devices.

2. Related Art

Hearing aid devices are commonly used to assist users who have difficulty in hearing. The hearing device typically includes a processor which receives surrounding sounds, processes the received sounds, and converts these sounds to an electrical signal, which is transmitted wirelessly via a coil acting as an antenna, to a corresponding coil implanted inside the user's skull. The external coil is often conveniently aligned with the implanted coil via one or more magnets associated with each coil. The implanted coil is typically just part of an implant system. Other parts of this system vary depending on the type of system.

In a cochlear implant system, for example, the internal coil is connected to an implanted stimulator which generates stimulating electrical signals corresponding to the received electrical signals, to stimulate nerves in the user's cochlea via an array of electrodes inserted into the cochlea. In Direct Acoustic Cochlear Stimulators (DACS) systems, the internal coil is attached to an actuator which is implanted in the middle ear to stimulate the cochlea via mechanical stimulation in accordance with the electrical signals received by the implant, from the external coil as described above. Other implant systems, such as auditory brain stem implant systems, exist and are within the scope of the invention. For the hearing device to function with any of these implant systems, the hearing device must be functionally connected to an internal system.

SUMMARY

In accordance with one embodiment of the present invention, a case for a BTE hearing device is provided. The case comprises a sealable opening through which the hearing device can be placed in the case, and a substantially flexible portion for receiving an antenna portion of the hearing device.

In accordance with another embodiment of the present invention, a case for a BTE hearing device is provided. The case comprises a protective portion, the protective portion being adapted to provide mechanical force protection for a first portion of a hearing device; and a flexible portion, the flexible portion being adapted to house a second portion of the hearing device such that the second portion maintains a fixed position relative to a reference point external to the case while the protective portion moves relative to the flexible portion In accordance with a still other embodiment, a case for a BTE hearing device is provided. The case comprises: a first portion adapted to fix a first position of a first portion of a hearing device within the case relative to a port located on the first portion of the case; and a second portion adapted to fix a second position of a second portion of the hearing device relative to a location external to the case.

In some embodiments, the case also has an acoustic port to facilitate sounds transmission to the device in the case, and a support inside the case to hold the device in a certain orientation.

DETAILED DESCRIPTION

Figure 1:
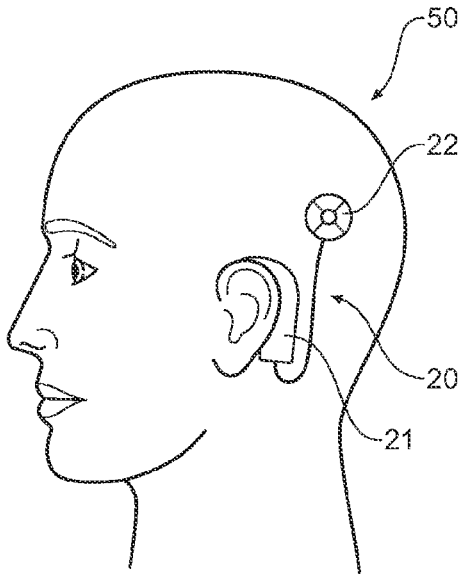
FIG. 1 is a schematic illustration of a BTE hearing device in place on a wearer's head.

FIG. 1 shows an exemplary Behind-The-Ear (BTE) hearing device 20 comprising, in this example, a processor portion, sometimes referred to as sound processor, 21 for receiving and processing sounds from around the wearer 50, and converting the processed signals into signals for transmission as electrical radio frequency (RF) signals. The RF signals are transmitted via antenna portion or coil 22 that in use, is located on the wearer's head, over or near, a corresponding antenna or coil implanted under the wearer's scalp for subsequent conversion into electrical signals and stimulation of the user's functional hearing system. In one embodiment, antenna portion 22 is a coil. It will be understood that antenna portion 22 may be configured to function as part of a transceiver that transmits RF signals to the implanted coil as well as receive RF signals from the implanted coil. In some applications, it will be appreciated that the implant will generate signals and transmit these to the hearing device 20 via the antennae or coils. When not in use, the hearing device 20, including the processor 21 and coil 22 can be removed.

Embodiments of the present invention are generally directed to a case that allows the wearer to continue conveniently using the hearing device when engaged in sporting or other activities that may otherwise affect or damage the hearing device. In certain embodiments, the case completely encase the hearing device and allows the coil 22 to be positioned in its usual position as shown in FIG. 1.

Figure 2:
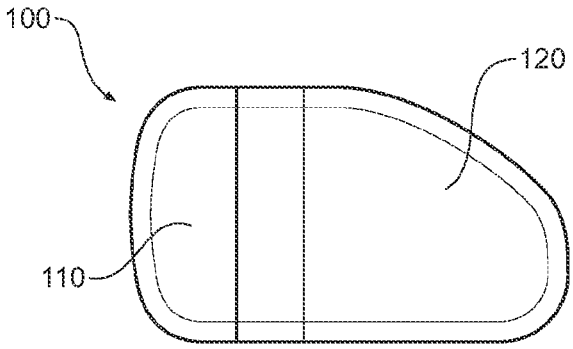
FIG. 2 illustrates a case in accordance with an embodiment of the present invention.

FIG. 2 shows a plan view of the case 100. The case 100 comprises a protective portion 110 and a flexible portion 120. The protective portion provides some mechanical protection to an article within the protective portion 110 by reducing at least a portion of the force of an impact applied to the protective portion passing through to the article within. In one aspect, the protective portion will protect sensitive electronic components within the hearing device from being damaged.

In embodiments described herein, the protection or force reduction is accomplished through the selection of hard or hardened materials, such as injection mouldable plastic (e.g., Polycarbonate Acrylonitrile Butadiene Styrene), metal and/or hardened rubber. In other embodiments, the protection or force reduction is accomplished through other techniques such as softer or less protective material formed into protective shapes or structures including skeletal structures, ribbing, and the like. In yet further embodiments, the protection or force reduction is accomplished through other techniques such as providing a force-absorbing or damping material within the protective portion 110. In one embodiment, a foam lining is provided on the inner surface which blankets and holds the portion of the hearing device within the protective portion 110. In another embodiment, a gel-like substance such as silicone is used to line the, or a part of, the inner surface of protective portion 110.

In this embodiment, the case 100 also comprises a flexible portion 120. In embodiments described herein, the flexibility of the flexible portion 120 is accomplished through the selection of soft materials, including soft rubber, silicon and/or polyurethane. In some embodiments, a part of the flexible portion 120 distal from the protective portion 110 is made from a non-flexible material, but is connected to the protective portion by a flexible material such as silicone rubber, to allow movement of the flexible portion 120 with respect to the protective portion. The term "soft" as used herein will be understood to mean sufficiently deformable or malleable to allow the flexible portion to substantially conform to the shape of the surface of the wearer's head at the location of the received coil 22. This can improve the co-location of coil 22 and the corresponding implanted coil and the communication of RF signals between the coil 22 and corresponding implanted coil.

In other embodiments, the flexible portion 120 is made of the same material as the protective portion but is thinned or otherwise structurally compromised to allow flexing within the flexible portion 120. In one embodiment, strips of material are etched away or otherwise removed to allow flexing. In yet further embodiments, flexible portion 120 is made of a protective material however there is a region over which the coil 22 sits when in the case 100, that is flexible or soft to allow the coil 22 to conform to the shape of the wearer's head at that point. In one embodiment, this region is about 40 mm to about 50 mm in diameter.

The protective portion 110 is made by any suitable techniques, including conventional injection moulding for plastic materials, metal injection moulding. In one embodiment, protective portion 110 is formed by machining. The flexible portion 120 is also made by any suitable method including conventional injection or transfer moulding. In one embodiment, flexible portion 120 is overmoulded onto the protective portion 110. The overmoulding process provides bonding. In embodiments with separate moulding, a glue is used in conjunction with some mechanical fixation such as snaps and/or clips.

Figure 3:
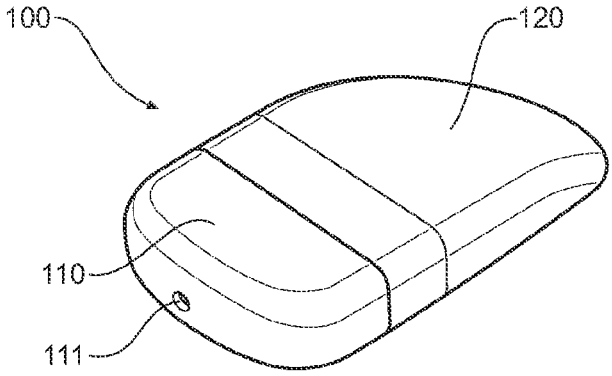
FIG. 3 illustrates the case of FIG. 2 having an acoustic port therein, in accordance with embodiments of the present invention.

FIG. 3 shows a perspective view of the case 100. In this embodiment, an acoustic port 111 is located in the protective portion 110. Acoustic port 111 can be any structure that allows sound energy to pass through more easily than through the case itself. In some embodiments, where waterproofing is not required, the acoustic port is an aperture in the case. In embodiments where waterproofing and/or sealing of the case is required, acoustic port 111 is provided by one or more regions where the casing material has been thinned, or in some embodiments, is provided by one or more protective membrane packaging vents such as those available under the brand name Gore™ Vents provided by W. L. Gore & Associates, Inc in Delaware, USA.

Figure 4:
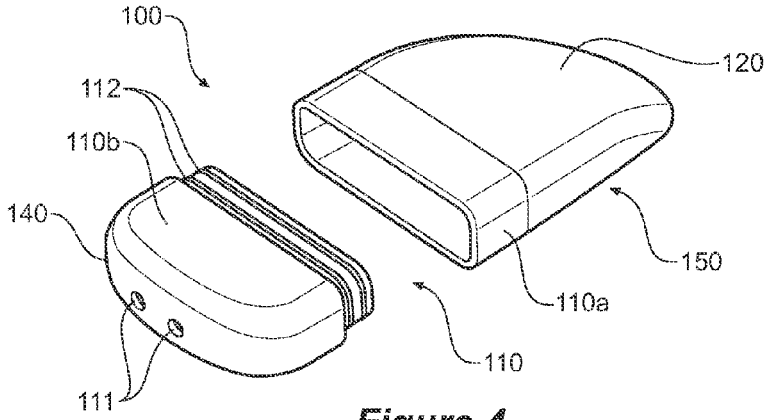
FIG. 4 illustrates a lid and base arrangement of the case in accordance with an embodiment of the invention.

FIG. 4 shows one embodiment of case 100, in which the protective portion 110 is formed in two (2) pieces and is able to be separated to provide a sealable lid 140. In the embodiment of FIG. 4, case 100 has base 150 which comprises the flexible portion 120 and a part 110*a* of protective portion 110. In some embodiments, in which the case is split at the protective portion/flexible portion interface, the base 150 comprises the flexible portion 120 only and the lid 140 comprises the entire protective portion 110.

In some embodiments, a seal is provided between the interface of the lid 140 and the base 150. In the embodiment in FIG. 4, the seal is provided by two O-rings 112. In some embodiments, other types of sealing are used, including tongue and groove, clips, screw threads, or using a grease or gel.

Figure 5A:
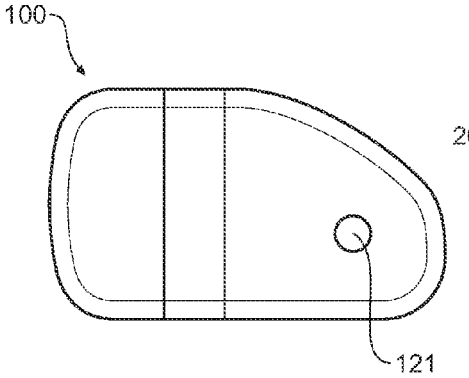
FIG. 5A illustrates a case according to an embodiment of the invention.
Figure 5B:
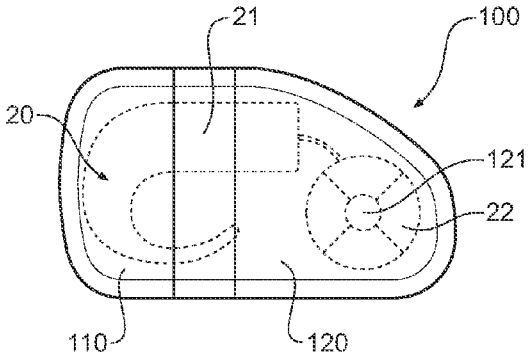
FIG. 5B illustrates the case of FIG. 5A with the hearing device enclosed therein, according to an embodiment of the invention.

FIG. 5B shows the case 100 with the encased hearing device 20 in dotted lines. As can be seen, at least the majority of the processor 21 is housed within protective portion 110 while the coil 22 is housed within the flexible portion 120. In this way, the protective portion 110 provides some protection to the processor 21 therein. The protection is provided in the form of protection against mechanical impacts that may be received during the wearer's activity (e.g. by a contact sport), and/or protection against dust (e.g. if riding a bike in a dusty environment). The flexible portion 120 also provides protection against agents such as dust, but because it is soft, it is able to conform to the curve of the wearer's head under coil 22 and allows the coil 22 to adopt a curved state to allow better contact with the wearer's head as will be described in more detail below.

In one embodiment, flexible portion 120 is provided with a magnet 121 to attract the magnet of the coil 22 to help locate and retain coil 22 within flexible portion 120. This arrangement is shown in FIG. 5A. FIG. 5B shows the case 100 of FIG. 5A with a hearing device 20 encased within. In one embodiment, magnet 121 is about 10 mm in diameter and about 1 mm in thickness. In another embodiment, magnet 121 is about 5 mm in diameter and about 1 mm in thickness. In another embodiment, magnet 121 is about 3 mm in diameter and about 0.5 mm in thickness.

As can be seen, at least a part of the processor or processor portion 21 is housed within protective portion 110 while the antenna portion or coil 22 is housed within the flexible portion 120.

In some embodiments, all or a portion of the case 100 is transparent or otherwise translucent, to allow visual access to the medical device 20 housed within case 100. This will allow observing of any water ingress and will allow any indicators, such as LEDs or other indicator lights to be viewed from the outside. As will be understood, some hearing device models can indicate one or more modes of operation of the hearing device via one or more visual indicators.

In some embodiments, the division between the hard/flexible portions is graduated so that the protective portion 110 transitions into the flexible portion 120. In other embodiments, the protective portion 110 and the flexible portion 120 is provided by the same material whose thickness is varied so that the material is thicker towards one end of the case 100 to provide the protective portion 110 and is thinner and more pliable towards the other end of the case 100 to provide the flexible portion 120. In one embodiment, the thickness varies from about 5 mm to about 2 mm from one end to the other end. In one embodiment, the thickness of the material in the flexible portion 120 that will be disposed between the coil 22 and the head of the user in use, is equal to or less than about 2 mm. This includes between about 2 mm and about 1 mm; between about 1.5 mm and about 0.5 mm; between about 0.5 mm and about 0.1 mm; about 1.8 mm, about 1.6 mm, about 1.4 mm, about 1.2 mm, about 1.1 mm, about 1 mm, about 0.8 mm, about 0.6 mm, about 0.4 mm, about 0.3, about 0.2 mm, and about 0.1 mm.

In some embodiments, flexible portion 120 is shaped differently to allow for variations in the placement of the coil 22 to accommodate different locations of the implanted coil due to surgeons' individual styles or preferences in implant placement. In yet further embodiments, at least a portion of the flexible portion 120 is flexible to allow flexible placement of the coil 22 over the implanted coil with respect to the rest of the case 100.

Figure 6:
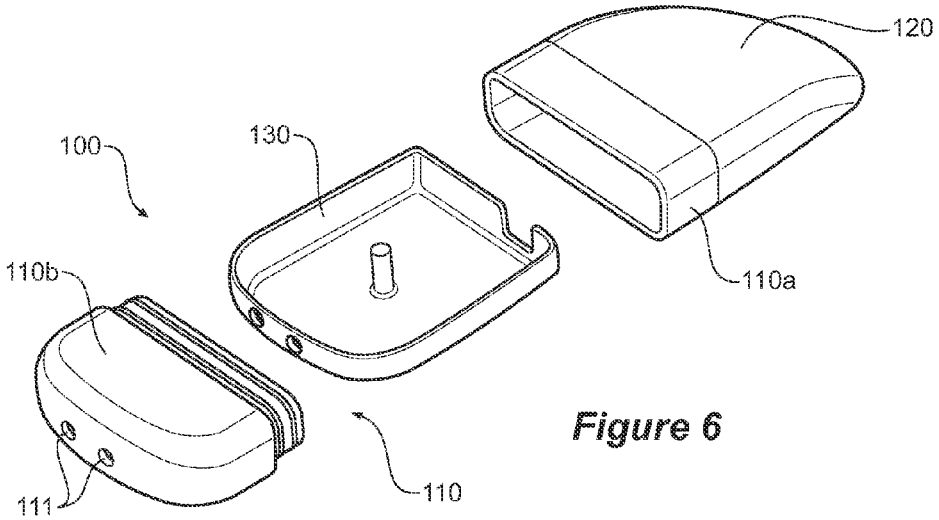
FIG. 6 illustrates a support tray for use with the case of FIG. 2 according to an embodiment of the invention.

In one embodiment, and as shown in FIG. 6, the positioning and retaining of the processor 21 within the case 100 is facilitated by the use of a support 130 within case 100. In one embodiment, support 130 comprises a tray which is removable from case 100. In one embodiment, tray 130 is itself constructed so as to provide location guides such as moulding in the shape of the processor 21, or guide pins, or guide walls.

Figure 7:
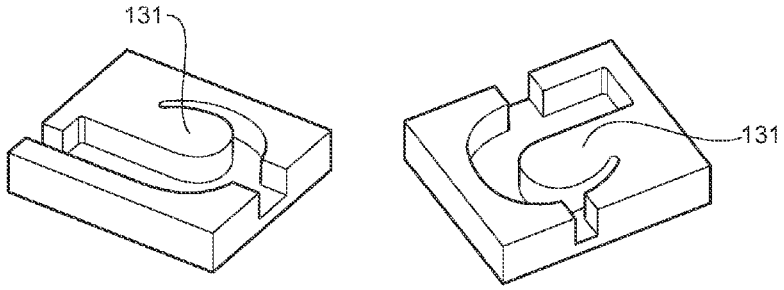
FIG. 7 illustrates a number of customised foam inserts for the tray according to an embodiment of the invention.

FIG. 7 shows a number of support 130 configurations in the form of foam padding 131 to support different hearing device models depending upon their shape and microphone locations. The foam padding 131 can be moulded or otherwise shaped to provide a stable location base in which to retain processor 21 in a particular position or orientation. The foam padding also provides increased sound absorption by absorbing reflected sound inside the case, further improving the function of the hearing device 20. The foam padding 131 also mechanically decouples the processor 20 from the walls of the case 100, reducing the audibility of mechanical vibrations on the case 100. Furthermore, in a swimming or water-sports application, the presence of foam padding 131 provides further protection to processor 21 by absorbing any moisture that may have entered the case 100, despite its sealing.

In one embodiment, this position maintains the processor 20 within about 10 mm of the acoustic port 111. In one embodiment, this position or orientation is such that the microphone of the processor 21 is directed towards the acoustic port 111, as shown in FIG. 5B. This orientation provides the most efficient access to the incoming sound energy into case 100 via acoustic port 111.

Figure 8:
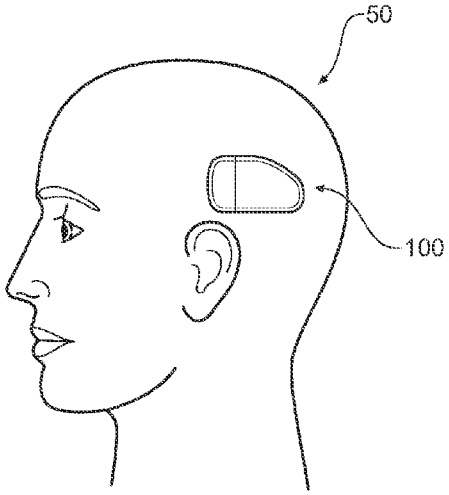
FIG. 8 illustrates the case as worn on a wearer according to an embodiment of the invention.

FIG. 8 shows a wearer 50 wearing case 100 housing a hearing device 20 (not visible in this view). The case 100 is located such that the coil 22 is located in substantially the same position on the wearer's head as it would when worn without the case 100.

A particular advantage of this arrangement is that there is no additional equipment required to allow the hearing device 20 to continue to provide hearing assistance to the wearer 50. In particular, in some prior art systems, where the hearing device is housed in a "body-worn" casing supported at the waist for example, there is also required a wire or cord connecting the processor to the coil on the user's head. In the arrangements disclosed herein, there is no need for any wires or cords connecting the hearing device 20 to the implanted device, or for providing "an extension cord" between the processor 21 worn on the body and the coil 22 worn on the head. The absence of such wires reduces inconvenience and eliminates any choking hazard to the wearer.

While in some embodiments, the case 100 is retained to the wearer's head by the magnetic attraction between the coil 21 and the corresponding implanted coil, in some embodiments, additional methods are also used to further secure the position of the case 100 on the wearer's head. These additional methods may depend upon the type of activity being undertaken. FIGS. 9A to 9D show a number of possible methods or apparatus for retaining the case 100 to the wearer's head.

Figures 9A, 9B, 9C, 9D:
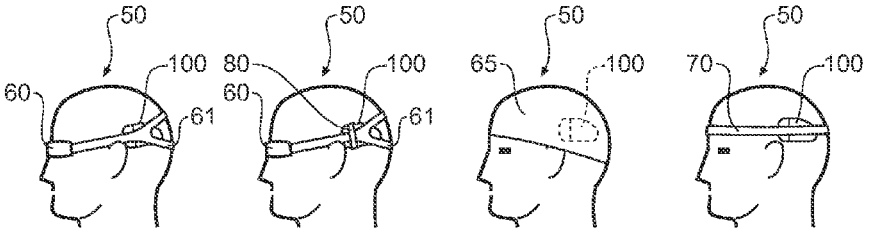
FIG. 9A illustrates a case worn by a wearer secured by a pair of swimming goggles according to an embodiment of the invention.
FIG. 9B illustrates the case as worn in FIG. 9A further secured by a clip according to an embodiment of the invention.
FIG. 9C illustrates a case worn by a wearer secured by a swimming cap according to an embodiment of the invention.
FIG. 9D illustrates a case worn by a user and secured by a head strap according to an embodiment of the invention.

FIG. 9A shows one embodiment in which a pair of swimming goggles 60, which are often used when swimming, is used to further secure case 100 on the wearer's 50 head. In this application, the strap 61 of the swimming goggles 60 is placed over the case. In one embodiment, the "Y"-point of the strap 61 is placed over at least a portion of the case 100 to provide even more security.

In FIG. 9B, even further security in retention is provided by a clip 80 in one embodiment, which in use is wrapped around the case 100 and the strap 61. In FIG. 9C, illustrating another swimming application, case 100, in one embodiment, is retained underneath a swimming cap 65. In one embodiment as shown in FIG. 9D, a general-purpose application of a headband 70 is used to retain case 100 to the wearer's head 50.

In one embodiment, case 100 is shaped (see for example FIG. 11B) so as to be able to be used on either or both sides of the wearer's head. This obviates the need to manufacture two different types of case shapes, one for each side.

Figure 10:
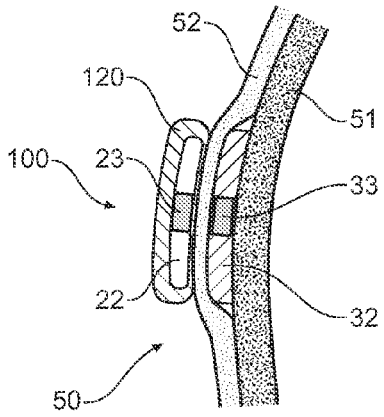
FIG. 10 shows a cross-section of the co-location of the coil and implanted coil in use on the wearer's head according to an embodiment of the invention.

FIG. 10 shows a close up cross section view of the position of the coil 22 inside the flexible portion 120 of case 100, when placed on the wearer 50 (not drawn to scale). Shown there is the corresponding implanted coil 32 located against the skull 51 of the wearer 50, underneath the scalp 52. As can be seen in FIG. 10, because the flexible portion 120 is soft it conforms to the shape of the wearer's 50 head at the location of the coil 22. This provides a more direct co-location of the coil 22 and the corresponding implanted coil 32. This provides a better communication between the two coils, and is also more comfortable for the wearer 50. In this view, respective coil magnets 23 and 33 of coils 22 and 32 are also shown, in substantial co-location.

In another embodiment, at least a portion of the case 100 is hydrodynamically shaped so as to be biased towards the wearer's 50 head when water flows over the case 100. This would occur in activities such as swimming laps in a pool or swimming underwater in a forward direction. FIGS. 11A to 11D show a case 100 that is hydrodynamically shaped. FIG.

Figure 11A:
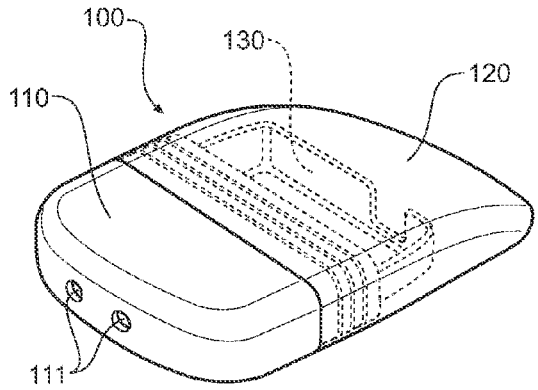
FIG. 11A illustrates a perspective view of the case with a shape to provide a hydrodynamic action.
Figure 11B:
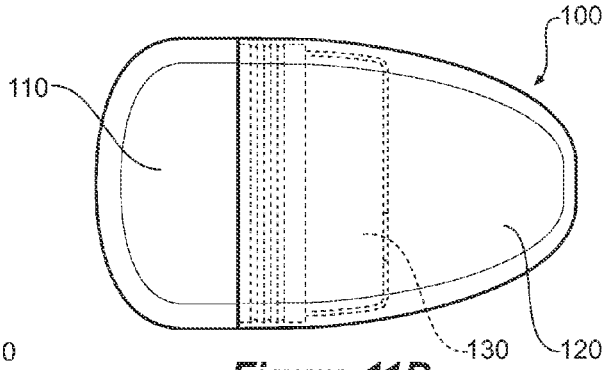
FIG. 11B illustrates a plan view of the case of FIG. 11A according to an embodiment of the invention.
Figure 11C:
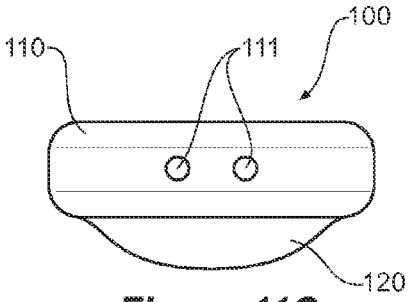
FIG. 11C illustrates a front end view of the case of FIG. 11A according to an embodiment of the invention.
Figure 11D:
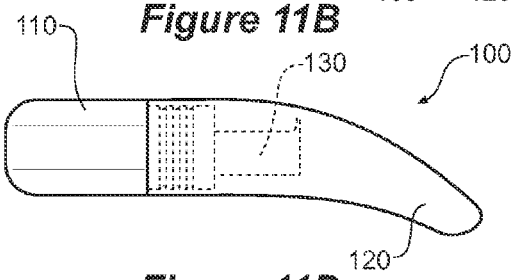
FIG. 11D illustrates a side view of the case of FIG. 11A according to an embodiment of the invention.

11A shows case 100 with protective portion 110 and flexible portion 120. In this embodiment, flexible portion 120 is substantially transparent or translucent, showing a part of the support 130 in the form of a tray inside the case. Also visible in this view are two acoustic ports 111. FIG. 11B is a plan view. In this view, it can be seen that case 100 is symmetrical about a longitudinal centre line, thus allowing the case 100 to be worn on either side of the wearer's head. FIG. 11C shows a front end view of the case 100 and FIG. 11D shows a side view, showing the profile of the case 100 that provides a hydrodynamic effect.

Figure 12:
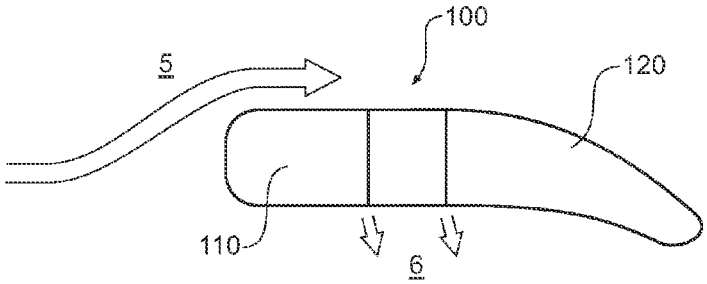
FIG. 12 illustrates the case of FIG. 11A providing a hydrodynamic effect according to an embodiment of the invention.

FIG. 12 shows the action of the hydrodynamic effect from the shape of the case 100, so as to provide a bias force as indicated by arrows 6 towards the wearer's head as water flows over the case as indicated by arrow 5.

Figure 13:
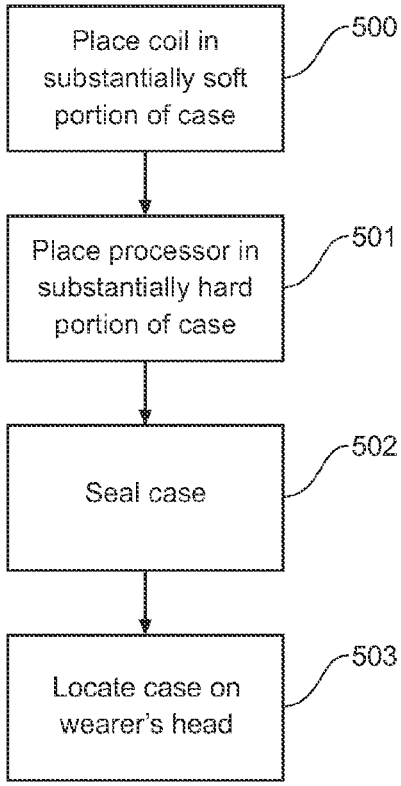
FIG. 13 illustrates a flowchart of a method of encasing the hearing device in the case according to an embodiment of the invention.

In another aspect, there is provided a method of encasing a BTE hearing device for the wearer to use during an activity. In this method, as shown in FIG. 13, the method comprises in step 500, placing the coil 22 in a flexible portion 120 of the case 100. In step 501, the processor is placed in a protective portion 110 of the case. In step 502, the case is sealed, and in step 503, the case is located on the wearer's head such that the coil is co-located with a corresponding implanted coil.

It will be appreciated that the step 501 of placing the processor in the protective portion could be performed before the step 500 of placing the coil in the flexible portion.

In one embodiment, the step of placing the coil in the flexible portion further comprises locating the coil in the flexible portion with a magnet in the flexible portion. In one embodiment, the step of placing the processor in the protective portion further comprises orienting the processor within the protective portion such that a microphone of the processor is directed towards an acoustic port of the case.

Figure 14:
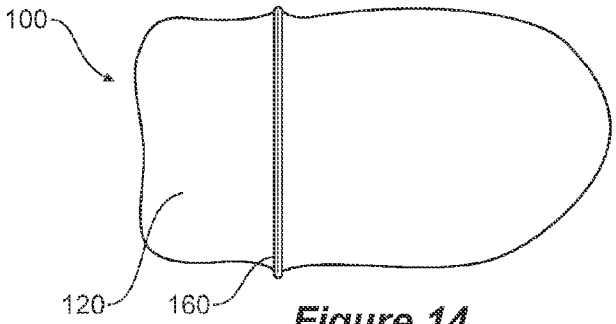
FIG. 14 illustrates a case according to an embodiment of the invention.

In yet another possible embodiment described herein and as illustrated in FIG. 14, the case 100 is formed entirely of the flexible portion 120. In this embodiment, the case 100 will not provide the protection against mechanical impact, however, it will still provide the advantages of protection against moisture, or dust, and will provide the advantage of conforming to the wearer's head thus allowing the coil 22 to properly conform to the wearer's head as previously described.

In one embodiment as illustrated in FIG. 14, case 100 comprises a sealable element 160 allowing the case to be opened to insert a hearing device and resealed to seal the hearing device therein. In one embodiment, the case 100 is shaped so as to substantially conform to a general outline of the hearing device.

Figure 15:
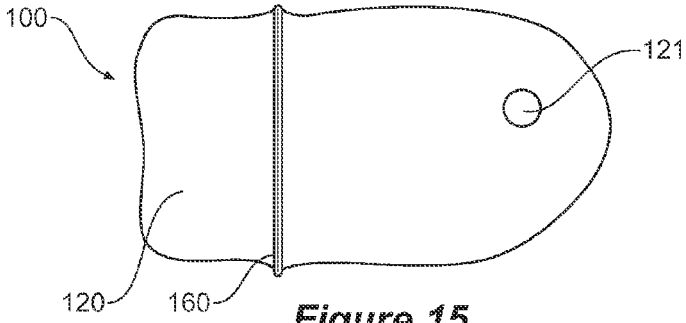
FIG. 15 illustrates a case according to an embodiment of the invention.
Figure 16:
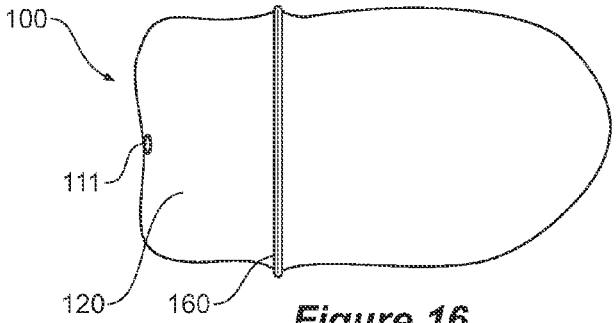
FIG. 16 illustrates a case according to an embodiment of the invention.

In one embodiment, as shown in FIG. 15, a magnet 121 is also provided at a convenient location within the case 100 so as to allow more effective placement of the coil 22 of the hearing device 20 within the case. In one embodiment as shown in FIG. 16, the case 100 is provided with an acoustic port 111.

Figure 17:
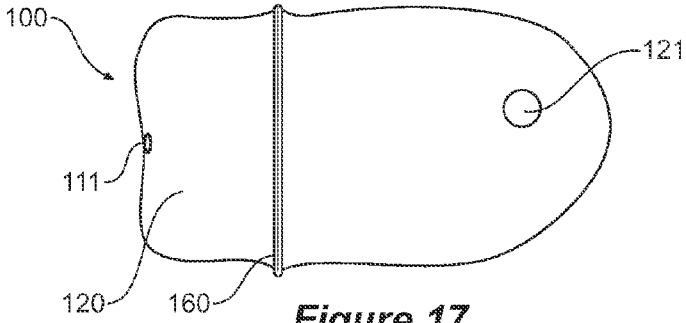
FIG. 17 illustrates a case according to an embodiment of the invention.

In one embodiment, the case 100 combines one or more of the features described with reference to FIGS. 14 to 16. In one embodiment for the example, the case will have both the magnet 121 and the acoustic port 111 as shown in FIG. 17.

Figure 18:
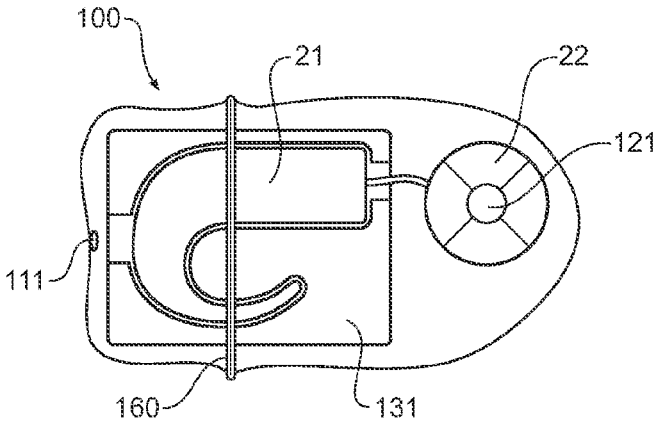
FIG. 18 illustrates a case according to an embodiment of the invention.

In one embodiment, a separate support such as a tray 130 is provided to further assist the location and orientation of the hearing device 20 within the entirely soft case 100. In one embodiment, a foam support 131 is provided to either provide the support entirely, or to sit within the tray 130. FIG. 18 shows an embodiment of this aspect, comprising support 130 in the form of a foam support 131, retaining processor 21 in an orientation such that its microphone is directed toward acoustic port 111 as previously described. Coil 22 is also located towards the end of the case 100 and retained by a magnet 121. Sealable opening 160 is provided to allow the hearing device and support 130/131 to be placed in and removed from case 100.

In one embodiment, a portion of case 100 is provided by protective portion 110 as previously described and as illustrated in FIG. 2 for example.

Figure 19A:
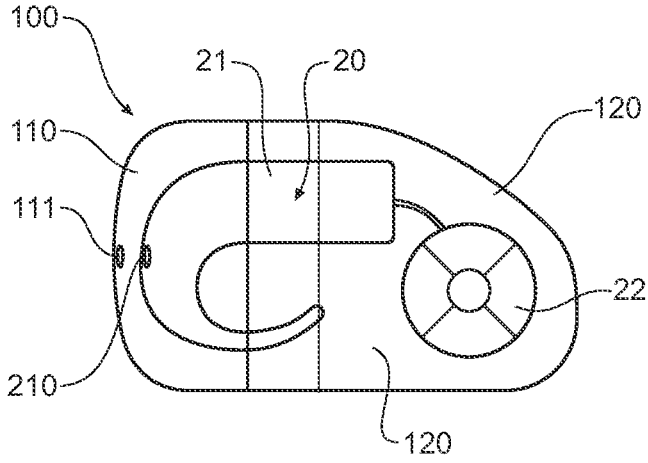
FIG. 19A illustrates a case according to an embodiment of the invention.
Figure 19B:
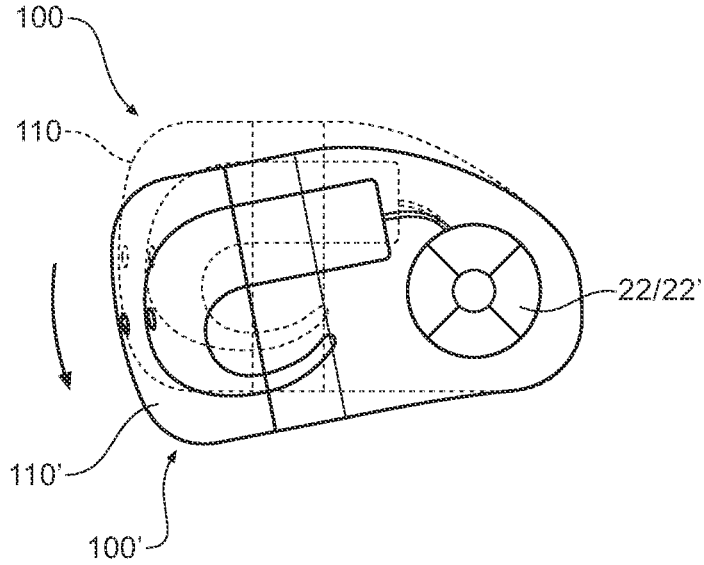
FIG. 19B illustrates the case of FIG. 19A having undergone movement according to an embodiment of the invention

Another embodiment and aspect of the present invention is illustrated in FIGS. 19A and 19B. In one embodiment, a case 100 comprises a hardened portion 110 as previously described. In one embodiment, the hardened portion 110 has a portal, which in one example is an acoustic port 111. The hardened portion 110 is adapted to house a first portion of a hearing device 20, in such a way that the first portion 21 is maintained in a substantially fixed position adjacent to the portal. In one embodiment, the first portion is a microphone 210 of the hearing device. In another embodiment, the first portion is a processor 21 of the hearing device 20.

As seen in FIG. 19A, the case 100 also comprises a flexible portion 120, which is adapted to house a second portion of the hearing device such that the second portion maintains a fixed position relative to a reference point external to the case 100 when the hardened portion 110 moves.

This aspect is illustrated in FIG. 19B which shows the original position of case 100 as was shown in FIG. 19A, illustrated in FIG. 19B as dotted lines. The new position of case 100 after some movement, is illustrated in full lines as case 100'. From this view, it can be seen that even though the hardened portion 110 has moved from its original position, together with the first portion of the hearing device, the second portion of the hearing device has maintained its original position, since the flexible portion 120 is able to flex to allow the hardened portion 110 to move with respect to the flexible portion. In this example, it is seen that the second portion of the hearing device has maintained its position relative to an external reference point. In one embodiment, the second portion is a coil 22 and the reference point is an implanted coil and in one particular example, is a magnet of the implanted coil as shown in FIG. 10.

It will also be seen that even though hardened portion 110 has moved, the first portion (e.g. microphone) has not moved relative to the port 111 and is still able to receive sounds from outside the case 100.

Accordingly, in this embodiment, the case 100 allows the coil 22 to be stably retained in a position over the implanted coil to allow continued RF communication between the coil and the implanted coil to allow the user continued use of the hearing device even if the user's activities such as swimming or running, result in some movement of the case.

In another embodiment, case 100 comprises a first portion 110 that is adapted to receive a first portion of a hearing device and fix its position within the case relative to a port located on the first portion. In one embodiment, the port is an acoustic port. In this embodiment, case 100 also has a second portion which is adapted to receive and fix in position, a second portion of the hearing device, relative to a position external to the case 100. In one embodiment, the second portion is flexile such that a movement of the first portion of the hearing device relative to the second portion of the hearing device does not move the second portion of the hearing device significantly from its position. In one embodiment, the second portion of the hearing device does not move more than about 5 mm from the position. In one embodiment, the second portion of the hearing device is a coil. In one embodiment, the position is a location on the wearer's head over an implanted coil. In this embodiment, because the case allows a part of the hearing device to move relative to another part (for example the coil), the coil still maintains effective or functional contact with the implanted coil to allow sufficient signals to be transmitted from the coil to the implanted coil to provide a hearing sensation in the wearer.

This action is also illustrated in FIGS. 19A and 19B which shows relative movement between the first portion of the hearing device (for example processor 21) and the second portion of the hearing device (for example coil 22).

In one embodiment, the first portion is hardened such that a portion of mechanical force applied to the hardened portion is not applied to the hearing device within the case.

It will be understood that that the various aspects have been described with reference to specific embodiments and that many variations and modifications can be made within the present disclosure. It will also be understood that the various aspects of the case and its embodiments and methods are equally applicable to any hearing device or system that requires a coil to engage with the wearer's head, including a cochlear implant system and a Direct Acoustic Cochlear Stimulation (DACS) system. Other applicable systems include:

ABI (Auditory Brainstem Implant)—an electrode for hearing, placed in the brainstem such as Cochlear Corporation's Nucleus 24 [R] Multichannel Auditory Brainstem Implant (Multichannel ABI). The auditory brainstem implant consists of a small electrode that is applied to the brainstem where it stimulates acoustic nerves by means of electrical signals. The stimulating electrical signals are provided by a signal processor processing input sounds from a microphone located externally to the user. This allows the user to hear a certain degree of sound.

FES (Functional Electrical Stimulation)—FES is a technique that uses electrical currents to activate muscles and/or nerves, restoring function in people with paralysis-related disabilities.

SCS (Spinal Cord Stimulator)—This system delivers pulses of electrical energy via an electrode in the spinal area and may be used for pain management. An example of a commercially available system is the RESTOREPRIME system by Medtronic, Inc, USA.

What is claimed is:

1. A case for a hearing device, the case comprising:
- a sealable opening through which the hearing device can be placed in the case;
- a substantially flexible portion for receiving an antenna component of the hearing device; and
- a magnet located within the substantially flexible portion for retaining the antenna component.

2. The case of claim 1 further comprising a protective portion for receiving a processor component of the hearing device.

3. The case of claim 1 wherein the antenna component comprises a coil.

4. A case for a hearing device, the case comprising:
- a sealable opening through which the hearing device can be placed in the case;
- a substantially flexible portion for receiving an antenna component of the hearing device; and
- a protective portion for receiving a processor component of the hearing device, wherein at least a portion of the protective portion forms a lid of the case.

5. The case of claim 4 further comprising at least one acoustic port for receiving sounds external to the case and transmitting the sounds to the interior of the case.

6. A case, comprising:
- a first portion including a protective portion adapted to provide mechanical force protection for a first component of a hearing device; and
- a second portion including a flexible portion, the second portion being adapted to:
  - engage the first portion; and
  - house a second component of the hearing device such that the second component maintains a substantially fixed position relative to a reference point external to the case while the protective portion moves relative to the flexible portion.

7. The case of claim 6 wherein the first portion component comprises a processor.

8. The case of claim 6 wherein the second component comprises a coil.

9. The case of claim 8 wherein the reference point is adjacent to an implanted coil.

10. A case, comprising:
- a first portion adapted to fix a first position of a first component of a hearing device within the case relative to a port located on the first portion of the case; and
- a second portion adapted to house a second component of the hearing device, the second component being configured to fix the position thereof relative to a location external to the case.

11. The case of claim 10, the second portion being further adapted to fix a second position of the second component of the hearing device within the case, wherein the second portion of the case is flexible such that a movement of the first portion of the case relative to the second portion of the case does not move the second portion of the case significantly from the second position.

12. The case of claim 10 wherein the first portion of the case is hardened such that a portion of mechanical force applied to the first portion of the case is not applied to the first component of the hearing device.

13. The case of claim 10 wherein the second component of the hearing device is a coil.

14. The case of claim 13 wherein the location corresponds to an implanted coil.

15. The case of claim 10 wherein the first component of the hearing device is a microphone, and wherein the port is an acoustic port.

16. The case of claim 15 wherein the first position directs the microphone towards the acoustic port.

17. The case of claim 15 wherein the second position is within about 10 mm from the acoustic port.

18. The case of claim 10 wherein the first position of the first component of the hearing device is fixed with a support.

19. The case of claim 18 wherein the support comprises a removable tray.

20. The case of claim 19 wherein the removable tray supports a foam padding.

* * * * *